United States Patent [19]

Gaggiano et al.

[11] 4,150,655

[45] Apr. 24, 1979

[54] LUBRICATING OIL SUMP FOR INTERNAL COMBUSTION ENGINES

[75] Inventors: Nicola Gaggiano; Giorgio Forlai, both of Turin, Italy

[73] Assignee: Fiat Societa per Azioni, Turin, Italy

[21] Appl. No.: 841,419

[22] Filed: Oct. 12, 1977

[30] Foreign Application Priority Data

Oct. 13, 1976 [IT] Italy ..... 69471 A/76

[51] Int. Cl.[2] ..... F01M 5/00

[52] U.S. Cl. ..... 123/196 AB; 184/104 B; 165/139

[58] Field of Search ..... 123/196 AB, 196 R; 184/104 B; 165/139, 140

[56] References Cited

U.S. PATENT DOCUMENTS 3,301,230 1/1967 Ryusuke ..... 123/196 AB

FOREIGN PATENT DOCUMENTS 1288850 2/1969 Fed. Rep. of Germany .... 123/196 AB 2034203 11/1969 Fed. Rep. of Germany .... 123/196 AB

*Primary Examiner*—Ronald H. Lazarus

*Attorney, Agent, or Firm*—Sughrue, Rothwell, Mion, Zinn and Macpeak

[57] ABSTRACT

A lubricating oil sump for an internal combustion engine has hollow side and bottom walls through the interspaces of which engine coolant is circulated to cool oil in the sump, the interspace in the bottom having a meandering flow passage and the internal surface of the sump bottom having longitudinal fins, covered partly by a plate, between which oil flows to be cooled by heat exchange with the engine coolant before entering an oil suction pipe.

5 Claims, 5 Drawing Figures

LUBRICATING OIL SUMP FOR INTERNAL COMBUSTION ENGINES

The present invention relates to lubricating oil sumps for internal combustion engines. More particularly, the invention concerns sumps of the kind having hollow side and bottom walls the interspaces of which form passages for the flow of engine coolant between inlet and outlet ports, for the purpose of cooling the oil in the sump by heat exchange with the engine coolant.

The object of this invention is to provide an oil sump of the aforesaid type which affords an efficient heat exchange between the lubricating oil and the engine coolant.

With this object in view the present invention provides a lubricating oil sump of the kind referred to characterised by the combination of the following features:

(a) the interspace of the bottom of the sump is subdivided into chambers interconnected as to define a substantially sinuous or meandering flow passage for the engine coolant between the inlet port and the outlet port;

(b) the bottom of the sump is provided on its internal surface with fins extending longitudinally of the sump;

(c) a plate rests upon the said fins, the plate being spaced from the longitudinal end walls of the sump by apertures which extend transversely for admitting oil into the bottom of the sump, and (d) the plate has, adjacent each of its two longitudinal edges, a hole for the passage of oil which communicates with a suction pipe for withdrawing oil from the sump.

This combination of features enables efficient and economical cooling of the engine oil to be achieved without the need for special heat exchangers. The oil flow rate can be increased, compared with that in previously known sumps of this type, by virtue of the presence of the fins, which make for more efficient cooling of the oil. The withdrawal of oil from the sump through two holes located on opposite sides of the medial longitudinal axis of the sump ensures a substantially uniform distribution of the flow of oil in the bottom of the sump.

Furthermore, by causing the engine coolant to flow in a sinuous flow passage between the inlet and outlet ports the effective surfaces for heat exchange are increased, allowing the speed of the fluids between which the heat exchange takes place to be increased.

The invention will be further described, by way of example, with reference to the accompanying drawings, in which.

Figure 1:
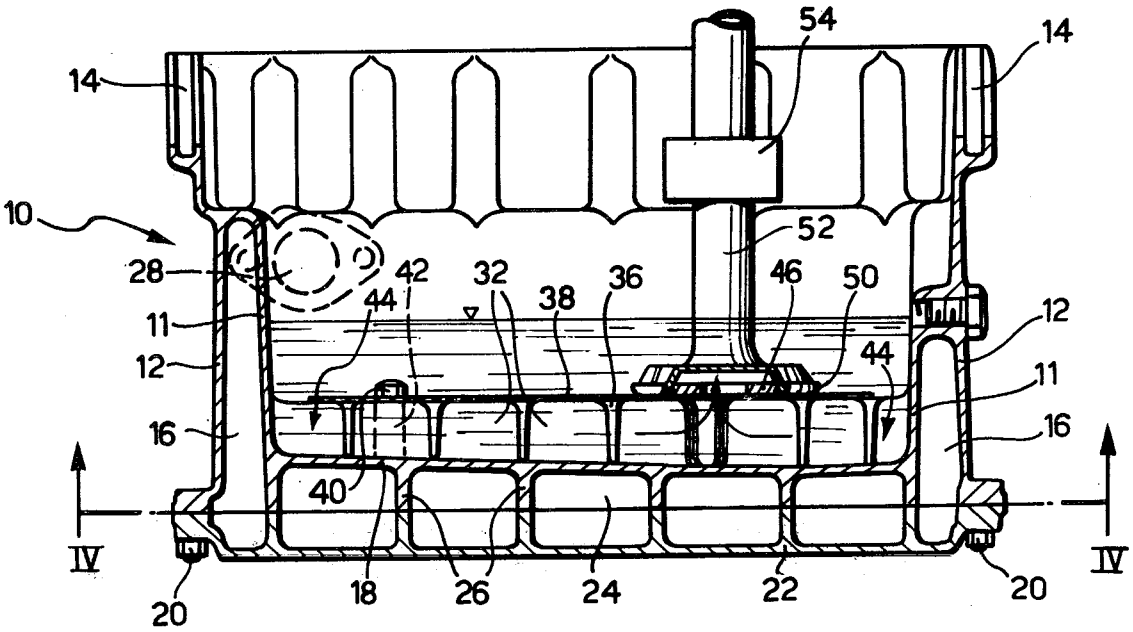
FIG. 1 is a longitudinal section of an oil sump according to one embodiment of the invention, taken along line I—I of FIG. 2.

Referring to the drawings, reference numeral 10 indicates generally a lubricating oil sump adapted to be fitted to the bottom of a cylinder block of a water cooled internal combustion engine. The sump 10 is diecast in an aluminum alloy and has four side walls 12 the two end walls of which are formed, in their upper edges, with two semicircular notches 14 for housing the sealing joints between the sump and the crankshaft housings (not shown) of the engine.

Figure 4:
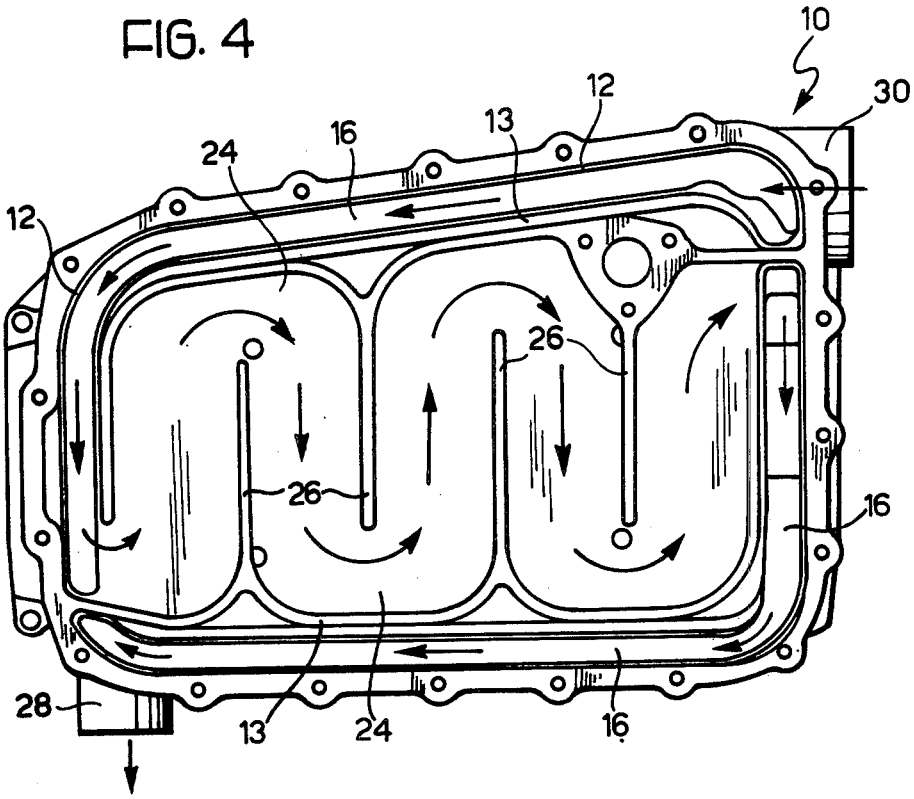
FIG. 4 is a cross section taken on line IV—IV in FIG. 1.
Figure 5:
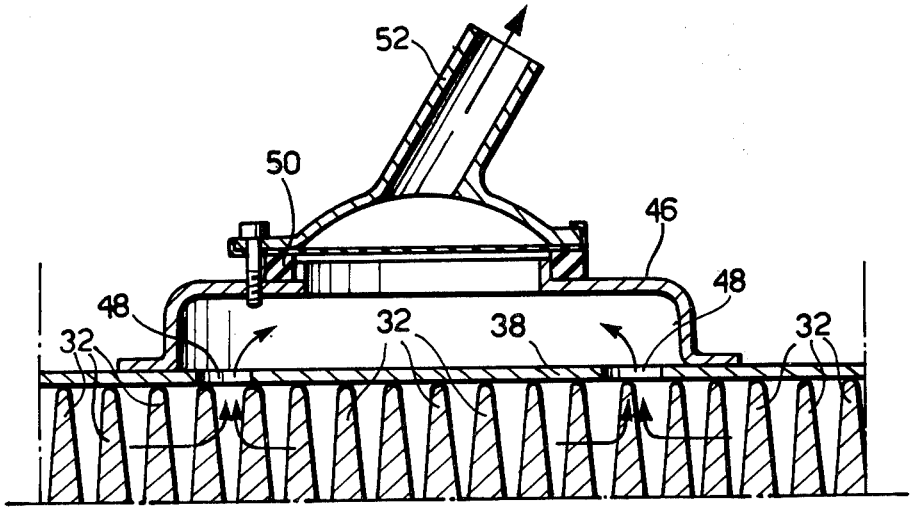
FIG. 5 is a sectional view on an enlarged scale taken on the line V—V of FIG. 2.

The four side walls 12 of the sump 10 are hollow, having interspaces 16. To the bottom 18 of the sump 10 there is affixed, by means of bolts 20, a cover 22 which is spaced from the bottom 18 to define therewith an interspace consisting of a number of internal chambers 24 which are connected to each other and with the interspaces 16 of the hollow side walls 12. As shown in FIG. 4, the internal chambers 24 of the bottom 18 are separated from each other by transverse ribs 26 which project alternately from opposite longitudinal edges 13 of the sump 10, so that the chambers 24 are interconnected to form a meandering flow path in the hollow bottom 18.

At one end of one of the side walls 12 there is provided an inlet port 30 adjacent the upper edge of the sump. An outlet port 28 is situated in the opposite corner of the sump adjacent the upper edge of the opposite side wall 12.

Figure 2:
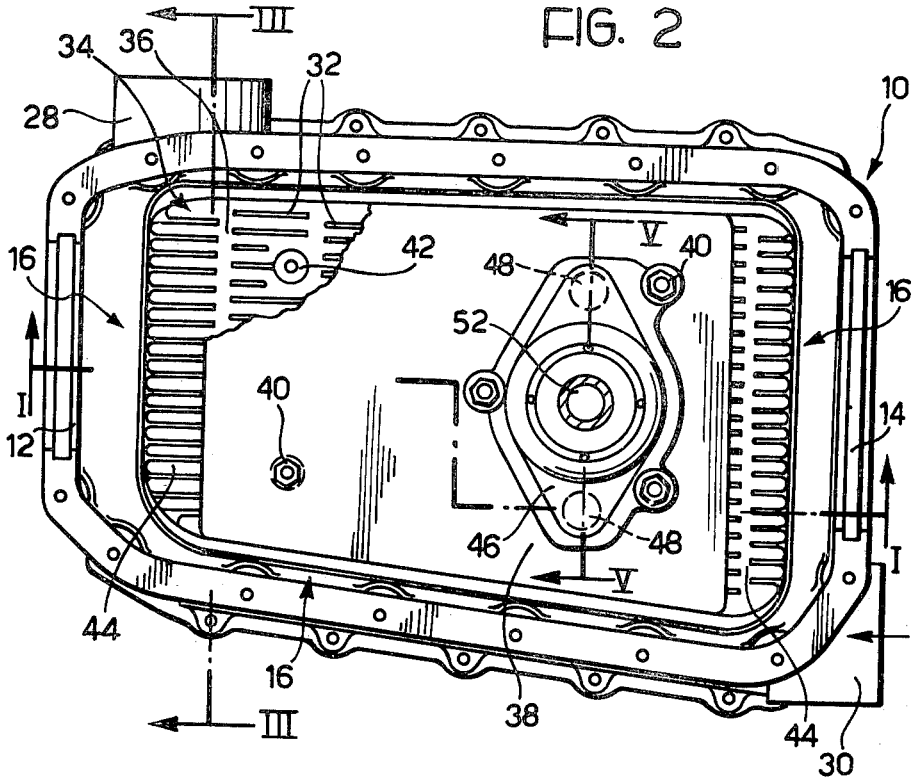
FIG. 2 is a partly cut away plan view of the sump shown in FIG. 1.
Figure 3:
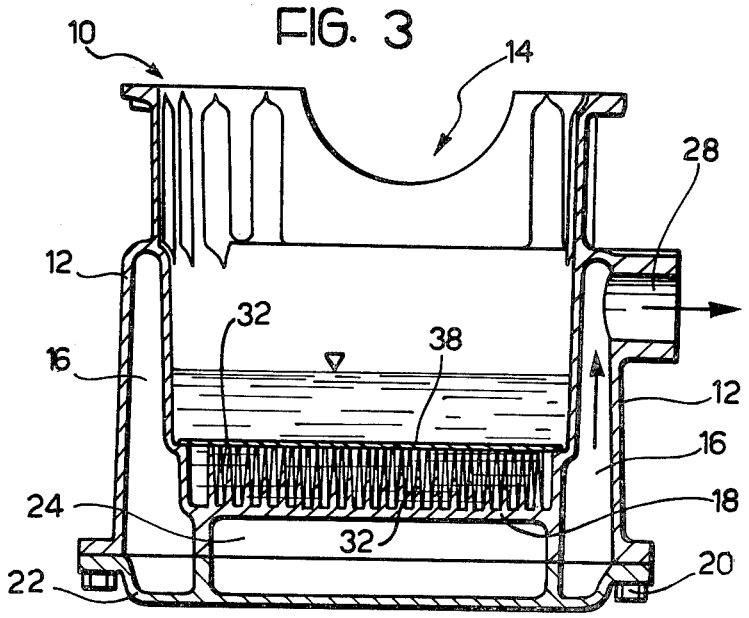
FIG. 3 is a cross section taken on line III—III of FIG. 2.

The bottom 18 of the sump 10 is provided, on its internal surface, with fins 32. The fins 32 extend longitudinally of the sump 10 and are arranged in a number of transverse rows 34 separated by non-finned regions 36. The fins 32 in successive rows are staggered relatively to each other, as shown in FIG. 2.

Upon the fins 32 there rests a metal plate 38, anchored to the sump 10 by means of bolts 40 screwed into respective threaded bosses 42 upstanding from the bottom 18 of the sump.

The longitudinal ends of the plate 38 are spaced from the internal surfaces 11 of the adjacent end walls 12 in order to define two transversely extending inlet apertures 44.

Affixed to the upper surface of the plate 38 is a boss 46 shaped with a substantially rhomboidal cross-section. Beneath the projection 46 two holes 48 are provided in the plate 38 near the opposite longitudinal edges of the plate 38. Upon the projection 46 there is fixed, with the interposition of an annular seal 50, a suction pipe 52 which connects the two holes 48 to an oil pump 54.

In operation of the engine coolant, for example water, is admitted into hollow walls of the sump 10 through the inlet port 30 and is circulated under force, in the direction of the arrows illustrated in FIG. 4, in the interspaces 16 of the side walls 12 and in the internal chambers 24 of the bottom 18, emerging through the outlet port 28.

The oil withdrawn from the sump 10 by the pump 54 flows through the spaces between the fins 32, passes through the two holes 48 in the plate 38 and the suction pipe 52, and through the oil pump 54 to the engine. After lubricating the engine oil drips back into the sump 10.

As the oil flows through the sump 10 a heat exchange takes place between the hot oil and the engine coolant circulating in the interspaces 16 and in the chambers 24. The heat exchange between the oil and the coolant is rendered more efficient in the region of the bottom of the sump 10 by the arrangement and conformation of the component parts of the sump, including the fins 32.

The invention is applicable to any type of internal combustion engine, including engines in stationary power plant and engines for motor vehicles. The invention is particularly applicable to motor vehicles which have a frontal air dam or a fairing, in which case, the air flow over the sump may be insufficient for adequate cooling of the lubricating oil.

It will be appreciated that constructional details of practical embodiments of the invention may be widely varied in relation to the embodiment herein described and illustrated purely by way of example, without nevertheless departing from the scope of the present invention.

We claim:

1. A lubricating oil sump for internal combustion engines of the kind having side walls and a bottom of hollow construction formed with interspaces for the flow of engine coolant to cool oil in the sump by heat exchange, and inlet and outlet ports communicating with said interspaces, wherein the improvement consists in the following characteristics in combination:

(a) means subdividing the interspace of the sump bottom into interconnected chambers defining a meandering flow passage for the engine coolant between the inlet and outlet ports;

(b) fins on the internal surface of the sump bottom, said fins extending longitudinally of the sump;

(c) a plate resting upon said fins, the plate being spaced from the opposite side walls of the sump to define apertures which extend transversely for admitting oil into the bottom of the sump, and (d) means defining holes in the plate adjacent each of its two longitudinal edges for the passage of oil, and a suction pipe communicating with said holes for withdrawing oil from the sump.

2. The sump defined in claim 1, wherein the fins on the sump bottom are arranged in a number of transverse rows, the fins in successive rows being staggered relatively to each other.

3. The sump defined in claim 1, including a cover and bolts securing the cover to the bottom of the sump to form the bottom wall of the said chambers in the sump bottom.

4. The sump defined in claim 3, wherein the chambers in the interspace of the sump bottom are defined both in the said cover and in the bottom of the sump.

5. The sump defined in claim 4, including transverse ribs which project alternately from opposite longitudinal edges of the sump to define the interconnected chambers in the interspace of the sump bottom.

* * * * *